US006101950A

United States Patent [19]

Kothe

[11] Patent Number: 6,101,950

[45] Date of Patent: Aug. 15, 2000

[54] PROJECTILE SIMULATION MEANS

[75] Inventor: Thorsten Kothe, Achim, Germany

[73] Assignee: COMET GmbH, Bremerhaven, Germany

[21] Appl. No.: 08/814,663

[22] Filed: Mar. 11, 1997

[30] Foreign Application Priority Data

Mar. 14, 1996 [EP] European Pat. Off. ..... 96104011

[51] Int. Cl.[7] ..... F42B 4/02; C06D 5/00

[52] U.S. Cl. ..... 102/530; 102/355; 102/430; 102/444; 102/469

[58] Field of Search ..... 102/334, 355, 102/395, 437, 444, 445, 462, 466, 467, 469, 470, 472, 498, 530, 531, 430, 464

[56] References Cited

U.S. PATENT DOCUMENTS

| | | | |
|---|---|---|---|
| 271,565 | 1/1883 | Baker et al. | 102/469 |
| 1,788,637 | 1/1931 | Schmidt | 102/469 |
| 3,279,373 | 10/1966 | Stadler et al. | 102/466 |
| 3,363,562 | 1/1968 | Stadler et al. | 102/466 |
| 5,138,948 | 8/1992 | La Mura . | |
| 5,585,595 | 12/1996 | Dix | 102/355 |

FOREIGN PATENT DOCUMENTS

| | | | |
|---|---|---|---|
| 2.022.758 | 11/1969 | France . | |
| 2 494 833 | 11/1980 | France . | |
| 2 025 584 | 5/1979 | United Kingdom . | |
| 1580185 | 11/1980 | United Kingdom | 102/467 |

*Primary Examiner*—Harold J. Tudor
*Attorney, Agent, or Firm*—Technoprop Colton LLC

[57] ABSTRACT

Projectile simulation means serve for an acoustic and/or optical representation of the firing of canons or the like. The projectile simulation means are arranged in a pivotable receiving plate of a firing apparatus. There is a danger that, when pivoting the receiving plate for closing the firing apparatus, the projectile simulation means drop out of the receiving plate.

According to the invention, the projectile simulation means are provided with spring tongues (27) which project from the outside of the casing (11) and are pressed together when pushing-in the projectile simulation means into the receiving plate. In this manner, the spring tongues (27) are resiliently preloaded, as a result of which they hold the projectile simulation means in the receiving plate in a hook-lie manner.

13 Claims, 3 Drawing Sheets

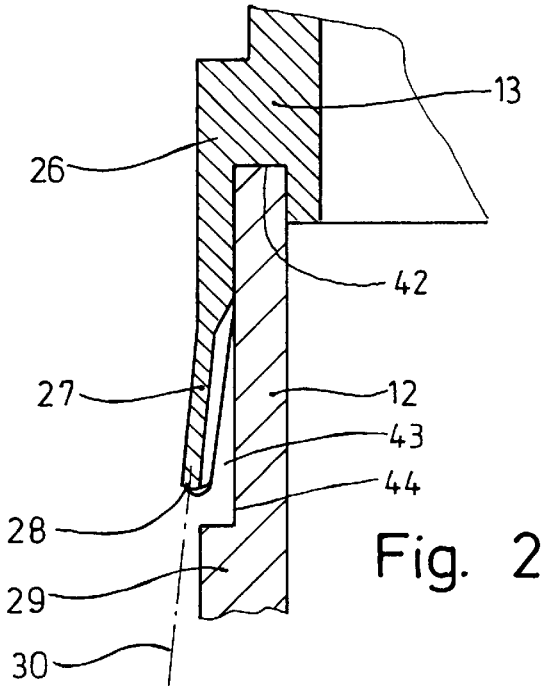
Fig. 2
Fig. 3
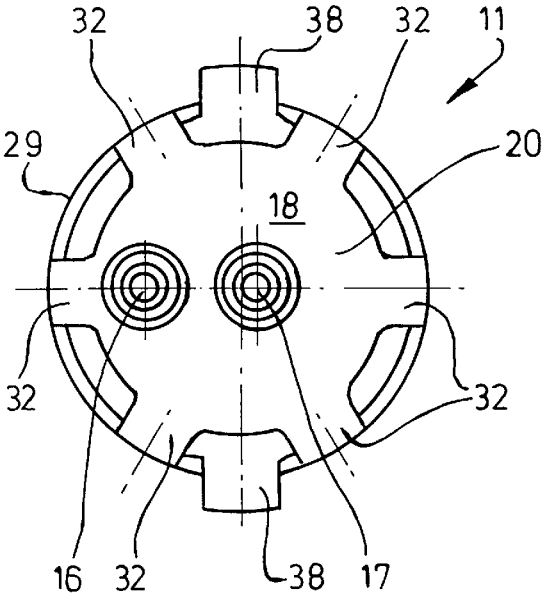
Fig. 4
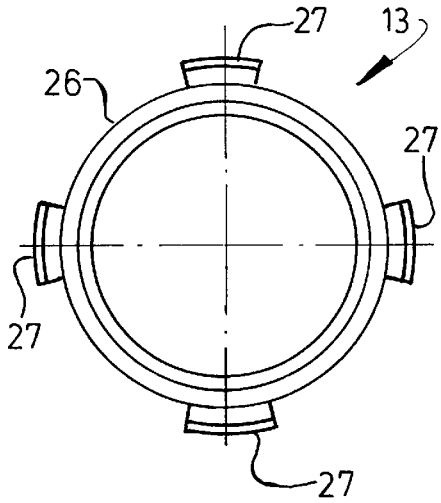

PROJECTILE SIMULATION MEANS

The invention relates to a projectile simulation.

Projectile simulation means mainly serve for the simulation of an acoustic and/or optical representation of the firing of canons or the like, especially a gun of a tank.

Such projectile simulation means are ignited in an apparatus for fire simulation. This apparatus is normally comprised of essentially two receiving plates. One of the receiving plates is stationarily mounted, for example on a tank. The second receiving plate is pivotably connected to the first receiving plate by means of hinges. For recharging the apparatus, the second receiving plate can be pivoted away from the first receiving plate.

The projectile simulation means are arranged in receiving bores of the pivotable (second) receiving plate. When pivoting together the receiving plates, the receiving plate with the projectile simulation means is oftenly pivotable into a position in which there is a danger that the projectile simulation means may drop out.

Consequently, the invention is based on the object to create a projectile simulation means which avoids dropping out of the respective receiving bore during recharge of the apparatus or during pivoting the receiving plate.

As a result of the fact that the casing is provided with at least one spring element by means of which a frictional engagement between the projectile simulation means and the receiving plate can be formed, the projectile simulation means is secured in the receiving bore or the receiving plate. Dropping out during the recharge of the apparatus is simply and reliably avoided in this manner. In the case of a multipart casing, the or each spring element may be arranged on any of the parts of said casing.

A bottom wall of the casing is provided with a depression for receiving ignition contacts. In this depression, for example water could accumulate. In a preferred embodiment of the invention, the casing, on a bottom wall, is provided with at least one groove which starts at the depression. On the one hand, this groove serves for avoiding a capillary effect by penetrating water within the apparatus; on the other hand, the groove allows the water to flow off, so that the projectile simulation means or the ignition contacts are protected from penetrating humidity.

Further preferred embodiments of the Invention will be explained in the subclaims and the description.

In the following, a preferred embodiment of the invention will be explained with reference to the drawings. In these:

FIG. 2 shows a detail II of FIG. 1, on an enlarged scale,

FIG. 3 shows a ground plan of a base of the projectile simulation means,

FIG. 4 shows a view IV according to FIG. 1 of a lid of the projectile simulation means.

The shown projectile simulation means serve for an acoustic and optical representation the firing of a canon, especially a gun of a tank.

Figure 1:
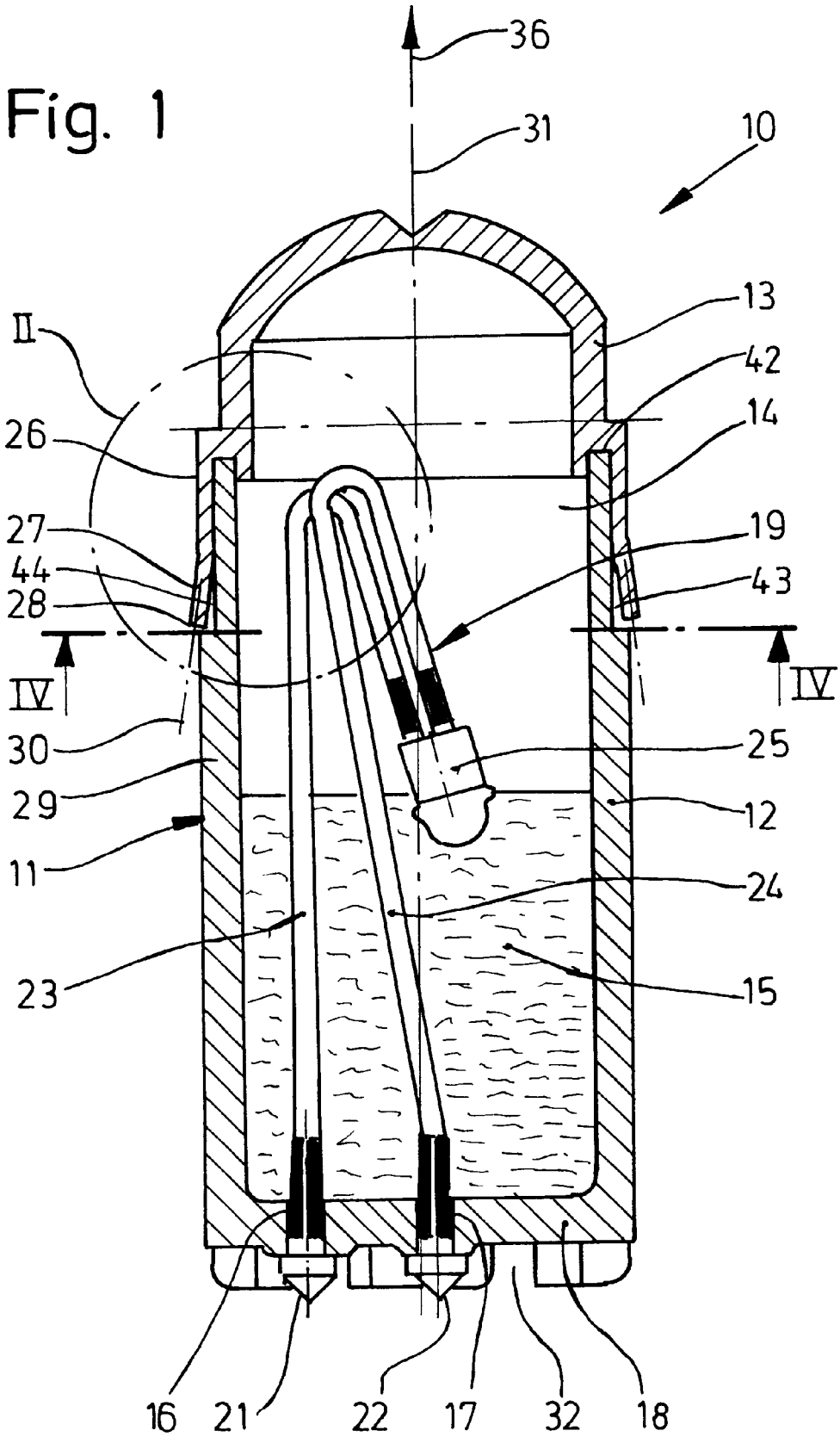
FIG. 1 shows a vertical section of a projectile simulation means.
Figure 5:
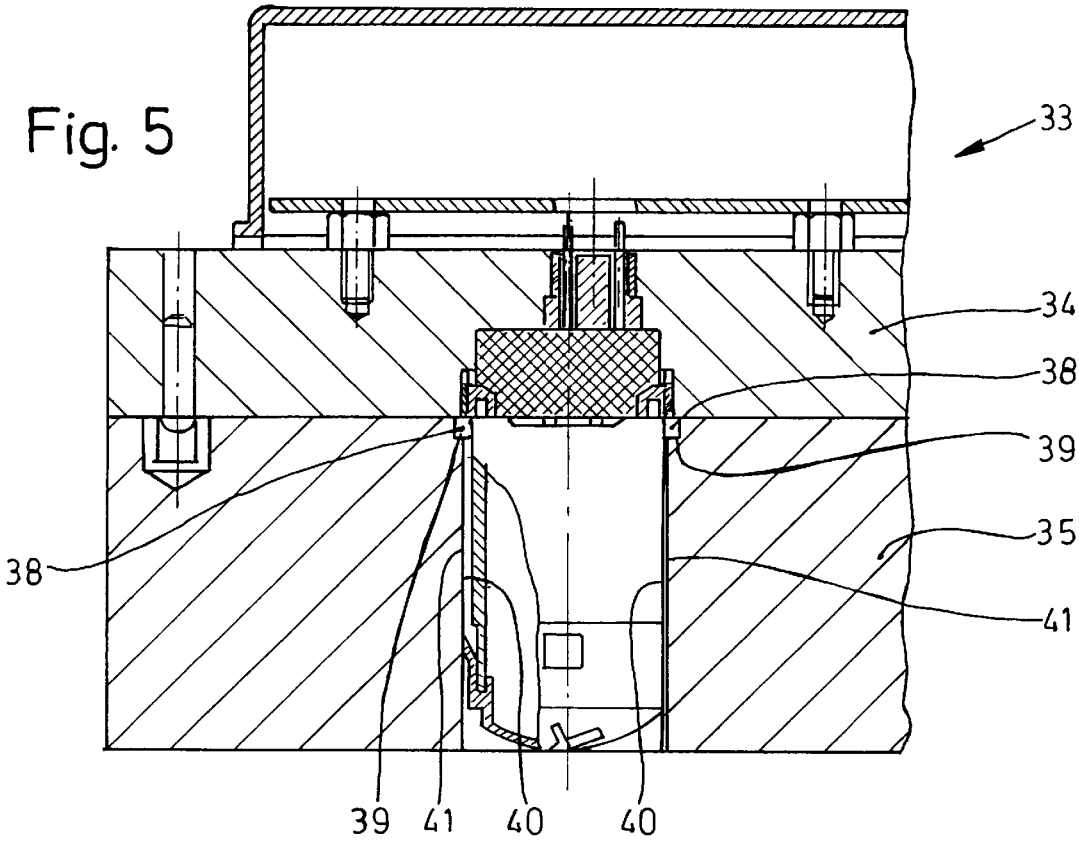
FIG. 5 shows a partial cross-section through an apparatus for firing the projectile simulation means.
Figure 6:
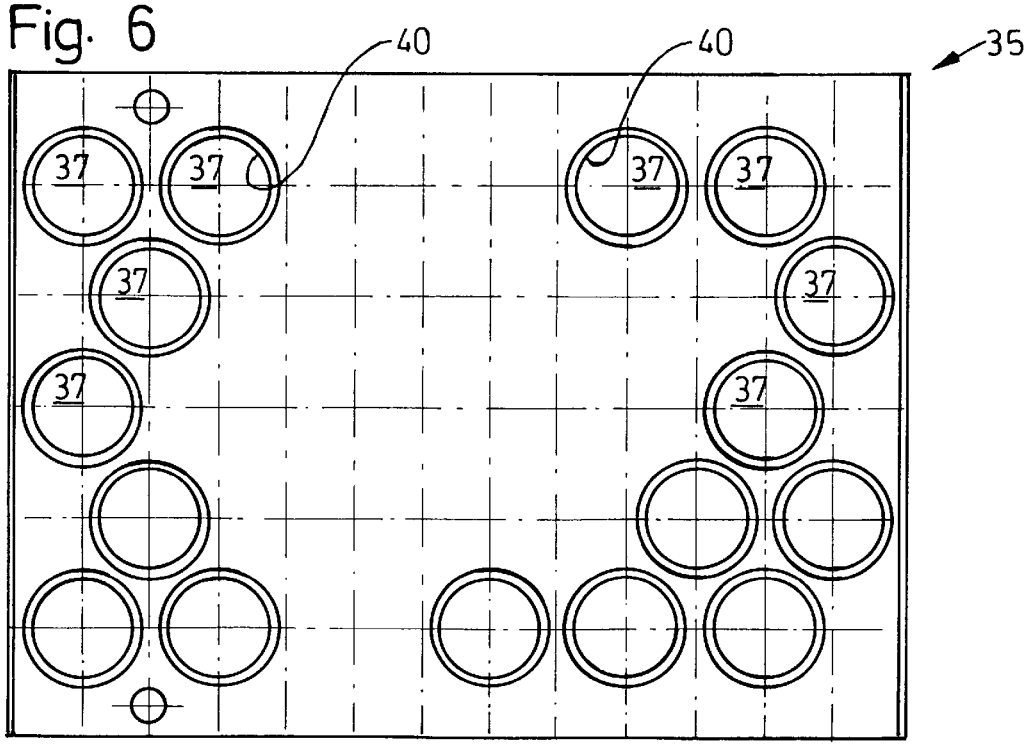
FIG. 6 shows a reduced representation of the ground plan of a receiving plate for a plurality of projectile simulation means in the open apparatus.

The projectile simulation means 10 shown in FIG. 1 is provided with a casing 11 comprised of two parts. The casing 11 has a base 12 and a lid 13, which are connected to one another, for example by friction welding. By connecting both parts, a closed chamber 14 is formed in which a pyrotechnic charge 15 is arranged. An ignition unit 19 projects into the chamber 14 through orifices 16, 17 in a bottom wall 18 of the base 12. In a depression 20 of the bottom wall, there are arranged ignition contacts which project to the outside. These ignition contacts 21, 22 are connected to a fuse 25 via lines 23, 21, the fuse 25 in turn being in contact with the pyrotechnic charge 15.

The lid 13 is closed at the end. The other end of the lid 13 is open and, at its periphery, delimited by an outer surface 26. The outer surface 26 of the lid 13 is adjoined by spring elements which take the form of spring tongues 27. The spring tongues 27 are directed towards the base 12 of the casing 11 and, with one end, connected to the lid 13 in one piece. On the side confronting the connection, the spring tongues 27 are provided with free ends 28. In the present exemplary embodiment, four spring tongues 27 are evenly distributed over the periphery of the casing 11.

Starting from an outer edge of the outer surface 26 of the lid, the spring tongues 27 extend obliquely relative to an outer surface 29 of the base 12, namely conically outwards with their free end 28. A longitudinal axis 30 of the spring tongues 27 has a greater outer diameter than the outer diameter of the casing 11. As a result, the spring tongues 27 project from the outer surface 29 of the base 12 in a radial direction.

The lid 13 with the spring tongues 27 is molded in such a manner during the production that the spring tongues 27 project obliquely outwards in the unloaded state as shown, in particular, In FIG. 1 and FIG. 2. The free ends 28 of the spring tongues 27 thus project from the cylindrical outer surface of the casing 11, and are thus directed outwardly. The cross-section of the spring tongues 27 is cambered. As a result, the spring tongues 27 are profiled, which increases the spring forces of the spring tongues 27. As shown, in particular, in FIG. 4, the camber of the spring tongues 27 corresponds approximately to the camber of the outer surfaces 26, 29 of the casing 11. In the longitudinal direction extending obliquely to the longitudinal axis of the casing 11, the spring tongues 27 are configured to be straight, and thus neither have a camber nor a profiling.

The cylindrical base 12 has a circumferential constriction 43 starting at the upper edge 42 which is directed towards the lid 13. The constriction 43 starts at the outer side of the base 12. As a result, in the region of the constriction 43, the base 12 has an outer surface 44 whose diameter is less than the diameter of the rest of the outer surface 29 of the base 12 outside the constriction 43. The length and the dimension of the constriction 43, and thus the difference in diameter between the outer surfaces 29 and 44, is adapted to the length and the thickness of the spring tongues 27. This adaptation is effected such that, when the spring tongues 27 are pressed against the outer surface 44 of the base 12, the spring tongues lie approximately flush with the outer surface 29 of the base 12 outside the region of the constriction 43 (FIG. 2).

The bottom wall 18 of the casing 11 has at least one groove 32 at its underside. In the bottom wall 18 of the base 12, two orifices 16, 17 are arranged in a depression 20. Through these orifices 16, 17, the lines 23, 24 can be guided into the chamber 14. The ignition contacts 21, 22 are arranged in the region of the depression 20. A plurality, preferably six grooves 32 are evenly distributed over the periphery of the bottom wall 18. The grooves 32 form a plane with the depression 20 and, starting from the depression 20, extend continuously to the outer edge of the casing 11 in the radial direction. In this manner, water can flow off the depression 20.

For firing, the projectile simulation means 10 are arranged in the apparatus 33. The apparatus 33 is provided with two receiving plates 34, 35 with a plurality of receiving bores 37. The receiving plates 34, 35 are connected to one another at one side by hinges which are not shown in the Figure. The hinges make it possible to pivot the receiving plates 34, 35 away from one another for recharging the apparatus 33. In the operating position, the receiving plates 34, 35 are folded together. The receiving plates 34, 35 are held together in the operating position of the apparatus 33 by locks which are not shown in the drawings either.

A recharging process of the apparatus 33 comprises the following steps:

The receiving plates 34, 35 are pivoted apart, the apparatus is thus opened. The projectile simulation means 10 can be inserted headlong, and thus with the lid 13 first, in the direction of the arrow (arrow 36) into the receiving bores 37 of the receiving plate 35. During the insertion of the projectile simulation means 10 into the receiving bores 37, the spring tongues 27 are pressed against the base 12 with their free ends 28, which are situated at the rear with respect to the direction of the arrow, and, as a result, resiliently deformed, so that a springing preload is created. As a result of the circumferential constriction 43 at the upper edge 42 of the base 12 and the corresponding configuration of the dimensions of the spring tongues 27, it is achieved that, when the spring tongues 27 are pressed against the outer surface 44 in the region of the constriction 43, the outer sides of the spring tongues 27 lie approximately flush with the outer surface 29 of the casing 12 which, in the region of the constriction 43, is greater than the outer surface 44.

Preferably two wing-like material accumulations 38 can be supported against a projection 39 of the receiving plate 35, such that the projectile simulation means 10 cannot be completely pushed through the receiving bore 37. When the desired number of projectile simulation means 10 is pushed into the receiving bores 37 in the described manner, the receiving plate 35 is folded against the receiving plate 34 for closing the apparatus.

The spring tongues 27 press against an inner wall 40 of the receiving bore 37, such that, as a result of the springing preload, a frictional engagement between the projectile simulation means 10 and the receiving plate 35 prevails. The camber of the spring tongues 27 is adapted to the receiving bore 37. As a result of the camber, relatively strong forces are generated when pressing together the spring tongues, by which forces the projectile simulation means 10 are held in the respective receiving bore 37. At least the lid 13 is made from a resilient or springing plastic which exerts the restoring forces. The spring tongues 27 prevent the projectile simulation means 10 from dropping out of the receiving plate 35 during the folding movement of the receiving plate 35 towards the receiving plate 34, especially during the "overhead-position". The spring tongues 27 function more or less as "barbed hooks", because they are directed away, namely extend in a diverging direction counter to the pushing-in direction (arrow 36) of the projectile simulation means 10 into the receiving bore 37, with their free ends 28 from a center axis 31 of the casing 11.

The gap 41 between the casing 11 and the inner wall 40 of the receiving bore 37 shown in FIG. 3 is configured to be as wide as shown in the drawing only for easy of representation. In practice, the receiving bore 37 is only slightly bigger than the casing 11.

What is claimed is:

1. Projectile simulation means with a generally cylindrical casing formed from a plurality of parts and which has an outer surface; and at least one pyrotechnic charge arranged in the casing;

said casing comprising a plurality of deformable spring tongues capable of being resiliently deformed from a non-deformed state to a deformed state, and at least one constriction in the outer surface being assigned to the spring tongues;

said spring tongues partially project beyond the outer surface in the non-deformed state, and lie approximately flush with the outer surface in the deformed state.

2. Projectile simulation means as claimed in claim 1, wherein the spring tongues (27) are evenly distributed over the periphery of the casing (11).

3. Projectile simulation means as claimed in claim 1, wherein the spring tongues (27) have an cambered cross-section.

4. Projectile simulation means as claimed in claim 1, wherein the spring tongues (27), with their free ends, extend so as to diverge from a center axis (31) of the casing (11) counter to the charging/pushing-in direction (arrow 36) of the projectile simulation means (10).

5. Projectile simulation means as claimed in claim 1, wherein the spring tongues (27) extend conically outwards.

6. Projectile simulation means as claimed in claim 1, wherein the spring tongues (27) project from an outer surface (29) of a base (12) of the casing (11) in a radial direction.

7. Projectile simulation means as claimed in claim 3, wherein the camber of the spring tongues (27) is configured analogously to the camber of the casing (11).

8. Projectile simulation means as claimed in claim 1, wherein the spring tongues (27) are arranged on a lid (13) of the casing (11).

9. Projectile simulation means as claimed in claim 8, wherein the spring tongues (27) are connected to the lid (13) in one piece.

10. Projectile simulation means as claimed in claim 8, wherein the spring tongues (27) are arranged on an outer edge of the lid (13) in the direction facing the base (12) of the casing (11).

11. Projectile simulation means as claimed in claim 1, wherein a bottom wall (18) of the casing (11) is provided with a depression (20) from which starts at least one groove (32).

12. Projectile simulation means as claimed in claim 11, wherein the bottom wall (18) is provided with a plurality of grooves (32) which are evenly distributed over the periphery of the bottom wall.

13. Projectile simulation means as claimed in claim 11, wherein the grooves (32) continuously extend in radial direction to an outer edge of the casing (11).

* * * * *